United States Patent [19]

Dobring et al.

[11] Patent Number: 4,822,189

[45] Date of Patent: Apr. 18, 1989

[54] DRIVE ARRANGEMENT FOR A RIBBON CASSETTE

[75] Inventors: Wilfried Dobring; Peter Güll, both of Berlin, Fed. Rep. of Germany

[73] Assignee: Nixdorf Computer AG, Paderborn, Fed. Rep. of Germany

[21] Appl. No.: 112,367

[22] Filed: Oct. 22, 1987

[30] Foreign Application Priority Data

Nov. 10, 1986 [DE] Fed. Rep. of Germany ..... 3638344

[51] Int. Cl.[4] ..... B41J 32/00

[52] U.S. Cl. ..... 400/208; 400/236.2

[58] Field of Search ..... 400/194, 195, 196, 196.1, 400/207, 208, 208.1, 225, 232, 227.2, 236.2; 242/197, 198, 199, 200

[56] References Cited

U.S. PATENT DOCUMENTS

| | | | |
|---|---|---|---|
| 2,879,341 | 3/1959 | Kucher | 242/198 X |
| 3,401,899 | 9/1968 | Goldberg | 242/198 |
| 3,514,050 | 5/1970 | Yamamoto | 242/198 |
| 3,804,227 | 4/1974 | Cappotto et al. | 400/208 |
| 3,813,057 | 5/1974 | Sakumoto et al. | 242/198 |
| 3,967,790 | 7/1976 | Hess | 400/196 X |
| 3,993,182 | 11/1976 | Steinke | 400/195 |
| 4,084,503 | 4/1978 | Pylant et al. | 400/196.1 X |

FOREIGN PATENT DOCUMENTS 125877 6/1986 Japan ..... 400/225

OTHER PUBLICATIONS

IBM Technical Disclosure Bulletin, vol. 26, No. 3A, Aug. 1983, pp. 1157–1158, "Self Aligning Ribbon and Tape Drive" by Lingle.

*Primary Examiner*—Charles Pearson

[57] ABSTRACT

A drive arrangement for an ink ribbon cassette or the like having a transport roll arranged inside of the cassette permits the cassette to be inserted and ejected in a direction perpendicular to the transport roll axis relative to the receiving compartment of a ribbon device and also provides an automatic coupling between the transport roll and a drive shaft forming part of the device. The drive shaft is shiftable between a coupling position and a decoupling position set back from the coupling position against the force of spring means. On the forward end of the cassette as it is inserted perpendicular to the transport roll axis is a ramp which during the inserting movement of the cassette runs against the drive shaft and pushes it to its decoupled position. When the cassette reaches its fully inserted position the drive shaft automatically catches into the transport roll. Special actuating means are provided for decoupling the drive shaft from the transport roll. The drive arrangement is especially useful for the ink ribbon cassettes of printers.

9 Claims, 2 Drawing Sheets

DRIVE ARRANGEMENT FOR A RIBBON CASSETTE

Figure 4:
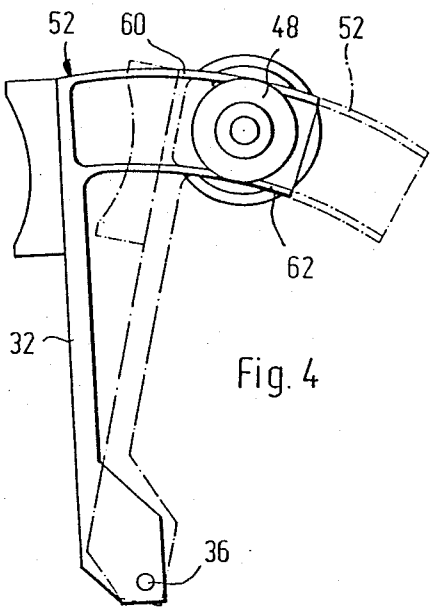

The invention concerns a drive arrangement for a ribbon cassette insertable in the cassette receiving compartment of a printer or typewriter.

In addition to cassettes, in the case of which the entire ribbon transport results from transport means arranged outside of the cassette, cassettes have been made wherein a transport roll arranged inside of the cassette is coupled with a drive shaft upon insertion of the cassette into the cassette, receiving device.

A drive arrangement of the specific type is already known in which the cassette is inserted in the direction of the transport roll axis and is removed from this axis (DE-OS No. 30 15 726). Upon insertion of the cassette a knife-like drive element formed on the front side of the drive shaft engages in a slit formed in the transport roll and couples the two together. Upon removal of the cassette from the cassette device the transport roll and the drive shaft separate again from one another in the axial direction so that the coupling is again broken.

A disadvantage of the known arrangement occurs in that the cassette must additionally be provided at several places with holding catch arrangements which fix the cassette in its functioning position in the receiving compartment. To release these catch arrangements which are spaced more or less far from one another relatively expensive actuating devices have to be provided. Moreover for construction reasons it is not always possible to insert or remove the cassette in the direction of the transport roll axis. An inserting or ejecting movement perpendicular to the transport roll axis presents however new construction problems, since the actual coupling and decoupling procedure between the drive shaft and the transport roll which lies entirely inside of the outer contour of the cassette in such case must take place in the axial direction.

The object of the present invention is to provide a drive arrangement which allows with the most simple construction means an insertion and ejection of the cassette perpendicular to the transport roll axis.

This object is achieved in accordance with the invention through the drive shaft being axially shiftable. In the decoupled position it is so far drawn back that the cassette can be pushed in or pushed out without hinderance. Cam surfaces formed on the leading end of the cassette cause the drive shaft upon insertion of the cassette to be automatically pushed to its decoupled position. Only when the drive roll is arranged co-axial with the coupling shaft is the coupling shaft pushed axially by spring means and coupled with the drive roll. By means of the coupling between the drive shaft and the transport roll the cassette is at the same time secured against movement in the push out direction so that additional catches or fixing arrangements do not have to be provided. To permit removal of the cassette the drive shaft is shifted to its decoupled position with the help of additional actuating means, whereby at the same time the locking of the cassette is also removed so that it can be ejected. The ramp surface provided according to the invention is constructively very simple and may without anything further be applied to cassettes of otherwise customary form so that cassettes of such form with nothing further can be used in connection with known cassette devices.

In further development of the invention the cassette and the receiving compartment are provided with cooperating guide arrangements for guiding the cassette in the inserting and ejecting direction. These assure an exact guiding of the cassette so that upon running of the ramp surface against the coupling end of the drive shaft the cassette cannot turn aside; on the other hand the guide arrangements assure an exact registration of the transport roll to the drive shaft.

In a further development of the invention the drive shaft extends through and beyond an opening in the boundary wall of the receiving compartment and is axially slidably supported by a bearing block arranged on the rear side of this boundary wall; the drive shaft has a flange which engages the rear side of this boundary wall in its coupling position, the flange in such way defining the coupling position. Between this flange and one wall of the bearing block is a compression spring which surrounds the drive shaft and urges it in the direction toward the coupling position.

It is provided in a further development that at the portion of the drive shaft opposite from the coupling end of the drive shaft an actuating lever is arranged; which lever serves especially for decoupling the transport roll from the drive shaft and for unlatching the cassette, as has already been described. The actuating lever is in one embodiment of the invention formed as a pivotal lever pivotal perpendicular to the drive shaft axis; this lever carries an actuating wedge which cooperates with a wedge arrangement located on the drive shaft, as is described in greater detail in connection with one of the exemplary embodiments.

In a further development of the invention a pinion coaxial to the drive shaft is journaled on the side of the boundary wall facing the receiving compartment, which pinion has a central recess complementary to the cross-sectional profile of the coupling end of the drive shaft. This allows a passage through and an axial shifting of the drive shaft relative to the pinion and effects at the same time a rotational coupling between the drive pinion and the drive shaft. The drive pinion itself is in suitable way connected with a drive motor.

Figure 1:
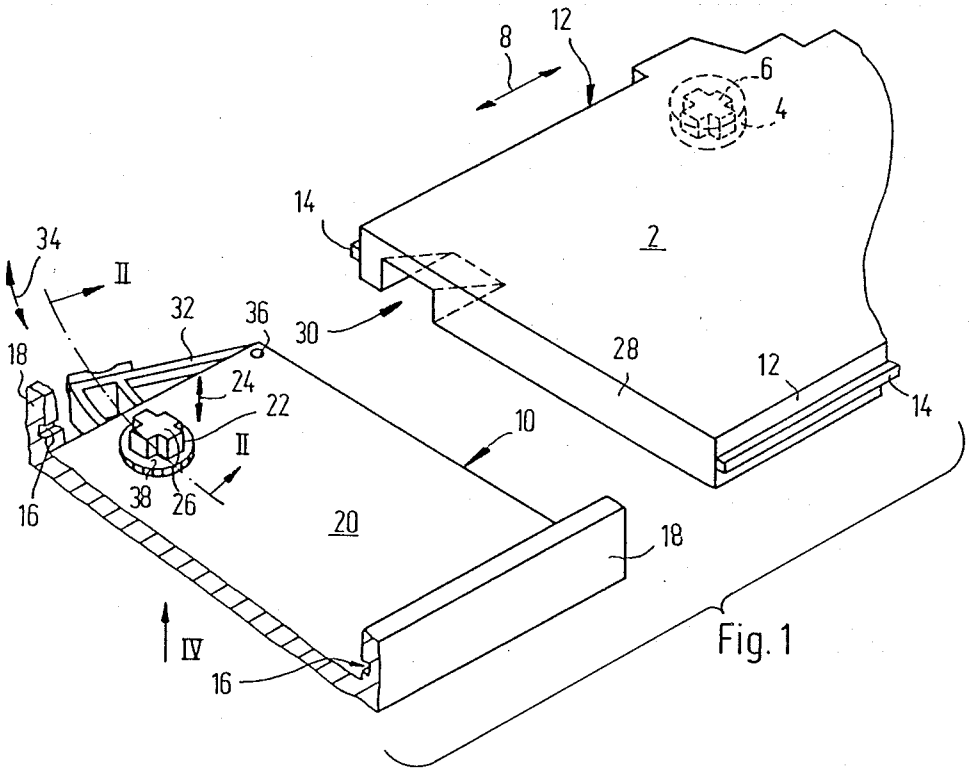
Figure 3:
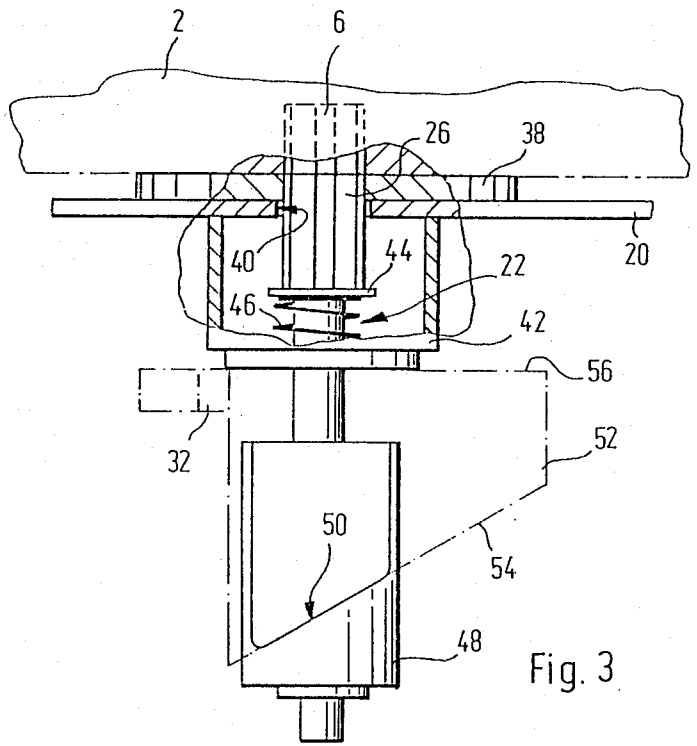
Figure 2:
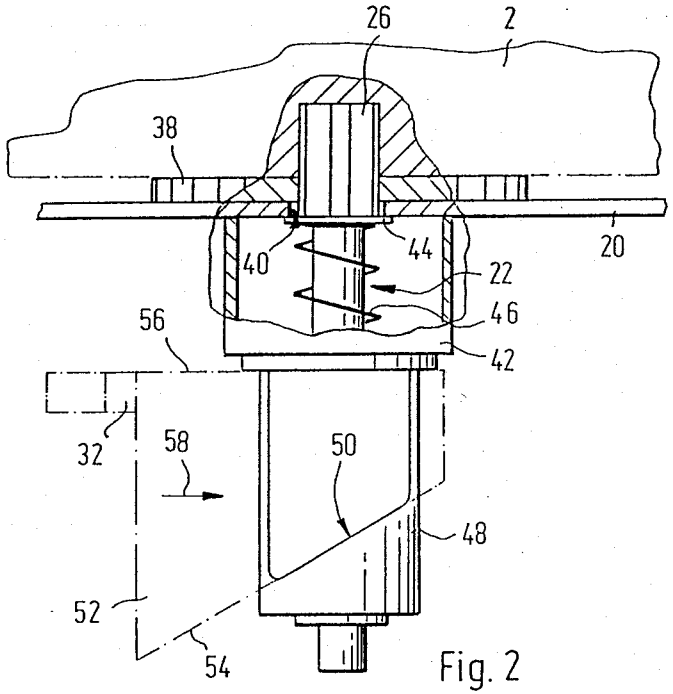

An exemplary embodiment of the invention is illustrated in the drawings and described in more detail in the following. The drawings show:

FIG. 1 in a perspective, fragmentary representation a cassette as well as a specific receiving compartment for receiving the cassette;

FIG. 2 a section corresponding to the line II–II of FIG. 1;

FIG. 3 a representation according to FIG. 2 wherein the drive shaft is in its decoupled position;

FIG. 4 a view of the actuating lever for shifting the drive shaft in the direction of the arrow IV in FIG. 1.

The ribbon cassette illustrated in FIG. 1 has an essentially rectangular flat form. Inside of the cassette 2 a transport roll 4 is rotatably supported, which transport roll transports a ribbon, for example an inked typewriter or printer ribbon, contained in the cassette 2. The transport roll 4 is provided with an axial coupling recess 6, which can be formed as either a blind recess or as a through-going recess. The cassette 2 can be inserted into or ejected from the receiving compartment 10 of a ribbon device in the direction of the double arrow 8. For exact guiding of the cassette 2 in the receiving compartment 10 guide ribs 14 are formed on the longitudinal side edges 12 of the cassette 2. These ribs engage in guide grooves 16 formed in the side edges 12 of corresponding side walls 18 of the receiving compartment 10.

A drive shaft 22 projects through the lower boundary wall 20 of the receiving compartment 10. This is axially shiftable in the direction of the double arrow 24 between the entirely projected coupling position illustrated in FIG. 1 and a withdrawn decoupling position. The portion of the drive shaft 22 visible in FIG. 1 is its coupling end 26 which in cross-section has a somewhat cross-shaped profile. The cross-section of the coupling end is complementary to the cross-section of the coupling recess 6 of the transport roll 4. The coupling end 26 can therefore be positively mechanically coupled with the transport roll.

On the leading short side edge 28 of the cassette 2 a ramp surface 30 is formed, which upon insertion of the cassette 2 into the receiving compartment 10 runs against the drive shaft 22 and presses it downwardly so that it does not hinder the insertion of the cassette. With the further insertion movement of the cassette 2 the coupling end slides on and along the underside of the cassette 2, until it comes into co-axial registration with the transport roll 4, so that the coupling end 26 can then catch into the coupling recess 6. In order to ease the catching of the coupling end into the coupling recess in the case of a rotated position of the coupling end 26 relative to the coupling recess 6, the coupling end 26 and/or the coupling recess 6 can be chamfered in a known way.

After the catching of the coupling end 26 in the coupling recess 6 the cassette 2 is secured against being pushed out. To allow removal of the cassette from the receiving compartment 10 an actuating lever 32 is provided which is pivotally ted for movement in the direction of the double arrow 34 about a pivot point 36. Upon inward pivoting of the actuating lever 36 from the illustrated position the drive shaft 22 is pushed out of its illustrated coupling position to its withdrawn decoupling position, as explained in connection with FIGS. 2 to 4.

FIG. 1 also shows a drive pinion 38 co-axial to the drive shaft 22, which pinion is rotatably supported on the boundary wall 20. The drive pinion has a central recess complementary to the cross-shaped cross-sectional profile of the coupling end 26, which coupling end 26 passes through the drive pinion and permits the axial movement of the coupling end 26, and which effects a rotating coupling between the drive pinion 38 and the drive shaft. The drive pinion 38 is in a customary and therefore no more narrowly illustrated way connected with a drive motor.

FIGS. 2 and 3 show the drive shaft 22 whose profiled coupling end 26 extends through and beyond a pass-through opening formed in the boundary wall 20. A bearing block 42 arranged on the rear side of the boundary wall 20 serves for axially slidably supporting the drive shaft 22. The drive shaft 22 has in the area in which the coupling end 22 transitions into the shaft portion of the drive shaft, a flange 44, which in the coupling position of the drive shaft (see FIG. 2) lies against the boundary wall 20 and in that manner defines the coupling position of the drive shaft. Between the flange 44 and the lower wall of the bearing block 42 is a compression spring 46 which constantly urges the drive shaft 22 toward its coupling position.

The end of the drive shaft 22 opposite from the coupling end 26 projects out of the bearing block 42. This end carries a guide block 48 with a guide surface 50 inclined to the axis of drive shaft 22.

The actuating lever 22 carries an actuating wedge 52 whose wedge surfaces 54 and 56 cooperate with the guide surface 50 and the bottom side of the bearing block 42. With a shifting of the actuating wedge 52 in the direction of the arrow 58, as a result of an actuation of the actuating lever 32, the guide block 48 is pressed downwardly by the wedge action, until the position represented in FIG. 3 is reached. This position corresponds to the decoupled position of the drive shaft 22 in which the coupling end 26 is withdrawn from the coupling recess 6 of the cassette 2.

FIG. 4 shows the actuating lever 32 in full lines in the rest position and in broken lines in the actuated position. The actuating wedge 52 consists essentially of two parallel walls 60, 62 bent in the shape of circular arcs, whose centers lie on the bearing 36. The upper and lower edges of the two walls 60, 62 form the wedge surfaces 56 and 54. The two walls 60, 62 embrace the guide block 48. The guide block 48 has a circular cross-section, as can be understood from FIG. 4. In the area above the guide surface 50 the guide block is so flattened that the actuating wedge 50 forming walls 60, 62 closely engage the guide block 48.

The drive shaft 22 is rotatable relative to the guide block 48. The rotational drive of the drive shaft 22 results through the drive pinion 38, as has already been explained in connection with FIG. 1.

We claim:

1. A drive arrangement for use in a printer or typewriter, said arrangement comprising:

a ribbon cassette, a transport roll arranged inside of said cassette for rotation relative thereto about a transport roll axis, a device having a cassette receiving compartment, cooperating guide means on said cassette and on said device for guiding said cassette as it is moved into and out of said receiving compartment with said cassette during such movement being constrained by said guide means to movement in a direction perpendicular to said transport roll axis, a drive shaft carried by said device for rotation relative thereto about a drive shaft axis and having a coupling end, said cassette having a forward end which is the first part of said cassette which moves into said receiving compartment as the whole of said cassette is moved into said receiving compartment, said transport roll being mechanically drivingly coupleable in a form locking manner with said coupling end of said drive shaft which is arranged to be coaxial with said transport roll when said cassette is fully inserted in said receiving compartment, said drive shaft being axially shiftable between a coupling position and a decoupled position at which said coupling end of said drive shaft is backwardly spaced relative to the coupling position against the force of a spring means, said cassette having upper and lower face surfaces and having a cam surface formed said forward end thereof slopping toward one of said upper and lower surfaces which cam surface as a result of the insertion of said cassette into said receiving compartment runs against said drive shaft and shifts it into its decoupled position, and additional actuating means associated with said drive shaft for moving said drive shaft to its decoupled position.

2. A drive arrangement according to claim 1 wherein said cassette upper and lower face surface are arranged generally parallel to one another and to the direction in which said cassette moves in moving into and out of said receiving compartment, and said cam surface is formed as a ramp surface which in the insertion direction of said cassette extends from one of said cassette face surfaces rearwardly to the other of said cassette face surfaces

3. A drive arrangement according to claim 1 wherein said drive shaft in the area of its coupling end has a cross-sectional profile which is complementary to an axially extending coupling recess formed in said transport roll.

4. A drive arrangement according to claim 1 wherein said cassette has an essentially rectangular periphery with two longitudinal side edges and two short side edges, said device has two spaced side boundary walls defining opposite sides of said receiving compartment, and said guide means includes guide ribs on and extending longitudinally along said longitudinal side edges of said cassette and complementary guide grooves in said side boundary walls of said device, said cam surface being arranged adjacent one of said short side edges of said cassette.

5. A drive arrangement according to claim 4 wherein said device has a third boundary wall extending between said side boundary walls and generally parallel to said direction of movement of said cassette in moving into and out of said compartment, said third boundary wall having a front side facing said compartment and a rear side facing away from said compartment, said drive shaft extending through and beyond a passage opening in said third boundary wall and being axially shiftably supported by a bearing block arranged on said rear side of said third boundary wall.

6. A drive arrangement according to claim 5 wherein said drive shaft carries a flange which engages said rear side of said third boundary wall in the coupling position, and wherein said spring means includes a compression spring surrounding said drive shaft and located between said flange and said bearing block.

7. A drive arrangement according to claim 5 wherein said drive shaft has a rear portion opposite from said coupling end, and said additional actuating means being an actuating lever movably supported by said device, said actuating lever having a part engageable with said rear portion of said drive shaft for axially shifting said drive shaft in response to movement of said actuating lever relative to said device.

8. A drive arrangement according to claim 7 wherein said rear position of said drive shaft projects rearwardly beyond said bearing block, said rear portion of said drive shaft carrying a guide block rotatable relative thereto and having a guide surface inclined relative to said drive shaft axis, and said actuating lever being pivotally connected to said device for pivotal movement about an axis parallel to said drive shaft axis and having and actuating wedge positioned between said inclined guide surface of said guide block and an opposing surface formed on said bearing block.

9. A drive arrangement according to claim 5 wherein a drive pinion is supported on said front side of said third boundary wall coaxial with said drive shaft.

said pinion having a central recess, complementary to the cross sectional profile of said coupling end of said drive shaft, which permits said drive shaft to pass through it and to move axially thereof, said central recess and said coupling end of said drive shaft being noncircular in cross section so that a rotatable driving coupling is formed between said drive pinion and said drive shaft.

* * * * *